US010689874B2

(12) United States Patent
Tang et al.

(10) Patent No.: US 10,689,874 B2
(45) Date of Patent: Jun. 23, 2020

(54) METHOD FOR ARRANGING VERTICAL LIFTING INTENSIVE PARKING GARAGE

(71) Applicant: Feng Tang, Shanghai (CN)

(72) Inventors: Feng Tang, Shanghai (CN); Zhong Tang, Shanghai (CN)

( * ) Notice: Subject to any disclaimer, the term of this patent is extended or adjusted under 35 U.S.C. 154(b) by 0 days.

(21) Appl. No.: 16/320,090

(22) PCT Filed: Oct. 13, 2016

(86) PCT No.: PCT/CN2016/102024
§ 371 (c)(1),
(2) Date: Jan. 23, 2019

(87) PCT Pub. No.: WO2018/032595
PCT Pub. Date: Feb. 22, 2018

(65) Prior Publication Data

US 2019/0226225 A1 Jul. 25, 2019

(30) Foreign Application Priority Data

Aug. 18, 2016 (CN) ..... 2016 1 0685771

(51) Int. Cl.
*E04H 6/18* (2006.01)
*E04H 6/40* (2006.01)
*E04H 6/42* (2006.01)

(52) U.S. Cl.
CPC ..... *E04H 6/18* (2013.01); *E04H 6/40* (2013.01); *E04H 6/422* (2013.01)

(58) Field of Classification Search
CPC .. E04H 6/18; E04H 6/422; E04H 6/40; E04H 6/42; E04H 6/188; E04H 6/424
USPC ..... 52/174–176; 414/234–241
See application file for complete search history.

(56) References Cited

U.S. PATENT DOCUMENTS 1,303,978 A * 5/1919 Smith ..... E04H 6/188 414/249
2,120,751 A * 6/1938 Jenney ..... E04H 6/285 414/252
2,204,023 A * 6/1940 Mason ..... E04H 6/26 414/233
2,676,714 A * 4/1954 Buranelli ..... E04H 6/28 414/233
2,691,448 A * 10/1954 Lontz ..... E04H 6/422 414/252
2,726,774 A * 12/1955 Newsom ..... E04H 6/422 414/247

(Continued)

*Primary Examiner* — Brian E Glessner
*Assistant Examiner* — Adam G Barlow
(74) *Attorney, Agent, or Firm* — Li & Cai Intellectual Property Office

(57) ABSTRACT

Disclosed is a method for arranging a vertical lifting intensive parking garage. The garage comprises a main body tower garage (101), wherein a storage rack (102) composed of a plurality of storage garage spaces (106) is arranged in the center of the main body tower garage (101); each layer of the storage rack (102) is an independent movable garage; each layer of the storage rack (102) is provided with a left and right turnover parking stall (104) and is joined to two corresponding vehicle-supporting elevators (103); and different layers of the storage rack (102) can be rotated by a suitable angle as needed so as to be joined to another two vehicle-supporting elevators (103). This arrangement method can increase the number of garage entrances and exits, reduce the waiting time for accessing vehicles, and improve access efficiency.

6 Claims, 9 Drawing Sheets

(56) References Cited

U.S. PATENT DOCUMENTS 3,395,815 A * 8/1968 Johnson ..... E04H 6/22 414/232
5,243,796 A * 9/1993 Casini ..... E04H 6/225 414/239
5,267,822 A * 12/1993 Paravia ..... E04H 6/225 414/227
5,478,182 A * 12/1995 Hildebrand ..... E04H 6/282 414/261
5,864,995 A * 2/1999 Buch ..... B66F 7/14 414/227
5,893,696 A * 4/1999 Belinsky ..... E04H 6/225 414/253
6,004,091 A * 12/1999 Roth ..... E04H 6/282 414/253
6,085,124 A * 7/2000 Choi ..... G07B 15/02 700/217
6,212,832 B1 * 4/2001 Gao ..... E04H 6/225 414/261
6,332,743 B1 * 12/2001 Park ..... E04H 6/186 414/234
6,491,488 B1 * 12/2002 Vita ..... E04H 6/225 414/234
7,815,410 B2 * 10/2010 Shinozuka ..... E04H 6/22 187/411
2006/0018738 A1 * 1/2006 Yen ..... E04H 6/22 414/234
2011/0140658 A1 * 6/2011 Outwater ..... B60L 53/36 320/109
2013/0085596 A1 * 4/2013 Shani ..... E04H 6/285 700/217
2014/0000188 A1 * 1/2014 Vayda ..... E04H 1/1233 52/175
2014/0294543 A1 * 10/2014 Jarvinen ..... E04H 6/12 414/227
2017/0211286 A1 * 7/2017 Ye ..... E04H 6/22
2017/0282868 A1 * 10/2017 Mondro ..... B60S 13/02
2018/0247103 A1 * 8/2018 Hsu ..... G08G 1/04
2018/0258663 A1 * 9/2018 Maier ..... E04H 6/188

* cited by examiner

METHOD FOR ARRANGING VERTICAL LIFTING INTENSIVE PARKING GARAGE

BACKGROUND OF THE INVENTION

1. Field of the Invention

The present invention relates to the field of mechanical parking garages, and is applicable to the fields of large-scale vertical mechanical warehouses and cargo warehousing.

2. Description of Related Art

Currently, the internal structure of a large-scale vertical lifting parking garage is basically square (or rectangular) or circular. The large-scale garage here means a tower garage that can store more than 40 vehicles. The internal arrangement of a square (or rectangular) tower garage is shown in FIG. 1. One vertical elevator is arranged in the center, and parking stalls are provided on two sides. The elevator transports only one vehicle on each round trip, resulting in relatively low efficiency. Each operation takes a long time, and the time increases in rush hours. As a result, the waiting time is even longer. For example, ten people come to retrieve or park vehicles at the same time. It is assumed that three minutes is taken to serve one person. The tenth person needs to wait at least half an hour to retrieve or park a vehicle. The entire parking garage fails completely once the elevator encounters a failure, causing low safety and reliability.

Three types of circular tower garages are shown in FIG. 2, FIG. 3, and FIG. 4 below. In the first two circular tower garages, only one elevator is disposed in the center. Only one vehicle is transported each time in FIG. 2, and a plurality of vehicles can be transported each time in FIG. 3. However, a rotary apparatus is further required in the center for rotation for every horizontal movement to each parking stall, resulting in a longer access time and lower efficiency. The elevator in the center cannot have a high speed and a high overall transportation height due to structural limitations. Consequently, the vehicle storage capability of the entire parking garage is not very high. Therefore, the foregoing methods have relatively low efficiency like a square tower garage. Each operation takes a long time, and the time increases in rush hours. As a result, the waiting time is even longer. Similarly, the entire parking garage fails completely once the elevator encounters a failure, thus causing low safety and reliability.

In the last solution in FIG. 4, one more elevator is added in the center. Two vehicles can be transported at the same time, the efficiency of the garage is doubled, and the waiting time can be reduced by half. However, the two elevators separately belong to a left semicircle and a right semicircle and cannot work in place of each other. If one elevator encounters a failure, half the tower garage fails completely. The efficiency is low, and in addition, the safety and reliability are still not high.

Therefore, it is not difficult to find that at present all commercially available intensive vertical parking garages have very low efficiency, and the average waiting time is very long. Especially, congestion usually occurs in a rush period, resulting in questionable safety and reliability. In addition, parking stalls need to have a uniform size, and consequently the storage diversity is low.

SUMMARY OF THE INVENTION

The objective of the present invention is to provide a brand new garage space arrangement method that can multiply the storage capability and access efficiency with the same height and area. In addition, a plurality of elevator systems is used to operate as backups for each other to completely ensure the safety and reliability of a tower garage. The capability of storing vehicles having various sizes and types can be further designed in one same garage, so as to provide better storage capability for small-sized new-energy vehicles in the future, thereby completely resolving the parking problem in modern metropolises.

The present invention is to provide a large-scale, efficient mechanical parking garage by making full use of mature advanced technologies at present and by using creative combination and a clever arrangement method, so as to provide a larger space for the development of small-sized new-energy automobiles in the future. In addition, the tunneling shield technology is used to vertically construct the tower, the mature high-speed vehicle elevator is applied to the fast vertical transportation, the mature mechanical garage technology is used to solve the problem of parking space operation, and the mature Internet plus mobile APP technology is applied to the reservation access.

A method for arranging a vertical lifting intensive parking garage used in the present invention includes: a main body tower garage, wherein a storage rack and a plurality of vehicle-supporting elevators are arranged in the center of the main body tower garage, storage garage spaces are arranged on the storage rack, the plurality of vehicle-supporting elevators are arranged in position around the periphery of the main body tower garage; two sides of each layer of the storage rack are provided with a left and right turnover parking stall, two left and right turnover parking stalls are joined to two corresponding vehicle-supporting elevators, and storage garage spaces having different sizes are arranged on different layers of the storage rack and correspond to vehicle-supporting elevators having different sizes.

A system for arranging a vertical lifting intensive parking garage is controlled by a central server, the central server is connected to a mobile phone terminal of a user via the Internet, and the user places an access order by using the mobile phone terminal; wherein the main body tower garage is in a fully-automatic intelligent operation and the user retrieves a vehicle without entering the main body tower garage.

In the method for arranging a vertical lifting intensive parking garage used in the present invention, the storage garage spaces are arranged on each layer of the storage rack, and each storage rack is independent movable and is a planarly-moving mechanical garage.

In the method for arranging a vertical lifting intensive parking garage used in the present invention, each storage garage space arranged on each layer of the storage rack is moved freely to the left and right turnover parking stall according to an instruction to be joined to two corresponding vehicle-supporting elevators.

In the method for arranging a vertical lifting intensive parking garage used in the present invention, the storage garage spaces having different sizes are arranged on different layers of the storage rack, the storage garage spaces having the same size are paired and rotated by a suitable angle as needed so as to be joined to another two vehicle-supporting elevators according to the arrangement of the main body tower garage; wherein during an application to a small vehicle garage, the storage garage spaces are divided into two groups and arranged in a vertical manner on the storage rack, and four corresponding vehicle-supporting elevators are arranged in position around the periphery of the main body tower garage; wherein during an application to storage, the storage garage spaces are rotated by a suitable angle according to space requirements, and two corresponding vehicle-supporting elevators are arranged based on each angle.

In the method for arranging a vertical lifting intensive parking garage used in the present invention, the main body tower garage is built according to the vertical underground tunneling shield technology, and is to arrange a maximum quantity of garages for the vertical lifting intensive parking garage in a limited space, wherein the maximum valid inner diameter is over 15 meters, and one row or two rows of storage garage spaces is arranged on a single layer of the storage rack.

In the method for arranging a vertical lifting intensive parking garage used in the present invention, a cab of the vehicle-supporting elevator is provided with at least two cab parking stalls. The central server of the vehicle-supporting elevator comprises a cab tonnage measurement unit, a cab parking stall determining unit, a central processing unit (CPU), and a communications unit. The cab tonnage measurement unit is configured to: measure a total weight of the cab and a vehicle in the cab, and output first cab information according to the total weight in the cab. The cab parking stall determining unit is configured to: determine a parking stall occupancy quantity in the cab, and output second cab information according to the parking stall occupancy quantity. The CPU is configured to recognize whether the first cab information is less than the total weight. The CPU is configured to recognize whether the second cab information is equal to a total parking stall quantity of the cab. When the first cab information is greater than or equal to the total weight, or, the second cab information is equal to the total parking stall quantity of the cab, the CPU outputs, by using the communications module to a driving module, an instruction of directly reaching a farthest separation layer. The CPU is further configured to recognize whether the first cab information is greater than a half of the total weight. The CPU is further configured to recognize whether the second cab information is greater than a half of the total parking stall quantity of the cab. When the first cab information is greater than the half of the total weight, or, when the second cab information is greater than the half of the total parking stall quantity of the cab, the CPU controls another cab to stop at a specified separation layer.

In the method for arranging a vertical lifting intensive parking garage of the present invention, the original mode in which arrangement is made on two sides or in the circumference and only one elevator is disposed in the center is changed. All parking stall storage racks are arranged in the center, and one elevator is disposed respectively on both sides. In addition, on parking stall storage racks that are separated by several layers or an upper part and a lower part that are divided as needed, parking stall storage racks can be rotated by 90°, and two elevators are further added in the same direction. In this way, two elevators form one group, and the two groups operate as backups for each other, so as to serve corresponding parking stalls together. The overall safety and reliability of the parking garage are ensured. A total of four elevators operate synchronously. The efficiency of the parking garage is theoretically increased four times, and the average waiting time of the parking garage is theoretically reduced four times. In addition, the two groups of elevators can be designed into stalls having two different sizes to store different types of vehicles, so as to provide a freer space for the development of small-sized new-energy vehicles in the future.

The system for arranging a vertical lifting intensive parking garage of the present invention is further described below with reference to the accompanying drawings.

DETAILED DESCRIPTION OF THE PREFERRED EMBODIMENTS

Figure 5:
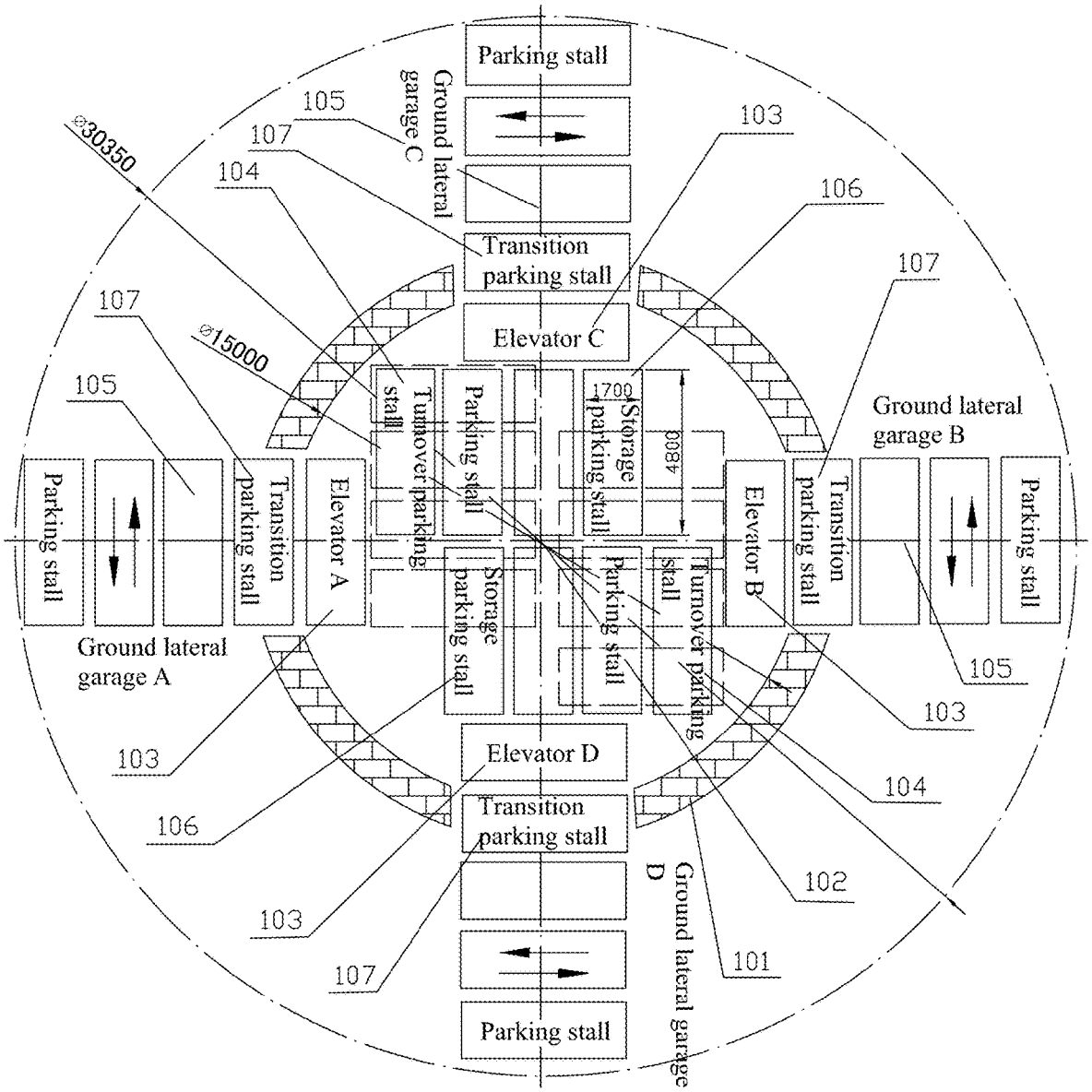
FIG. 5 shows a schematic diagram of a system for arranging a vertical lifting intensive parking garage (circular tower garage)
Figure 6:
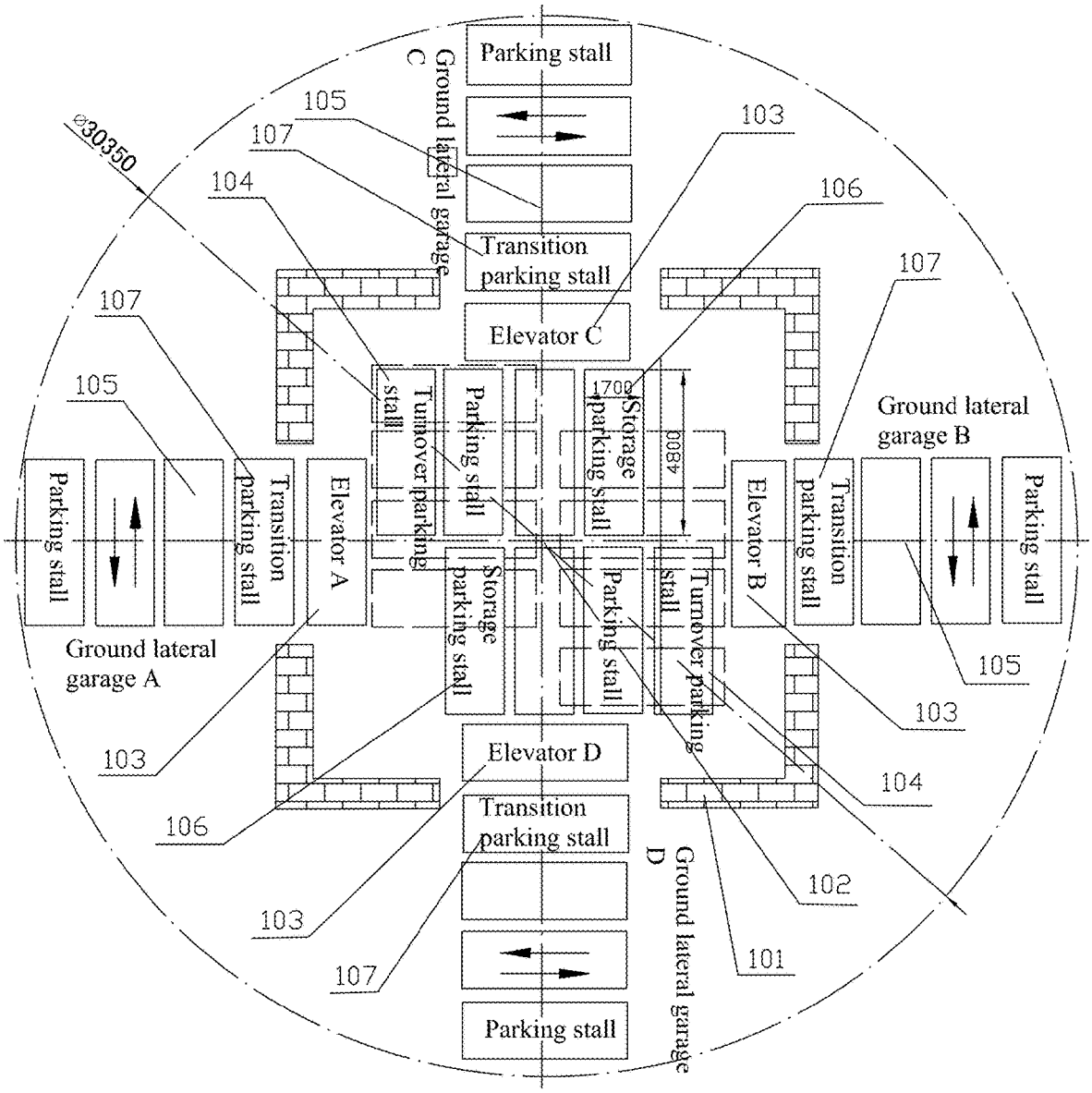
FIG. 6 shows a schematic diagram of a system for arranging a vertical lifting intensive parking garage (square tower garage)

In the present invention, a system for arranging a vertical lifting intensive parking garage comprises a main body tower garage part 101. The shape of the main body tower garage part 101 may be a circular shape (FIG. 5) or a rectangular shape (FIG. 6) or another shape, so that the system can be arranged aboveground or underground. If a building arranged aboveground is used, due to height limitations in cities, the height is not very high, the corresponding vehicle storage capability is not very high, and the arrangement of a parking garage does not have much use. There are currently many examples in the market. In addition, another major problem is the fire protection in tower parking garages. A tower garage requires huge costs in fire protection and has very high difficulty in fire protection. A currently mature vertical underground tunneling shield technology (the tunneling shield technology is used to build a tower garage, a shortest time is consumed, and the building costs are relatively low) is recommended here. A center well tower is constructed vertically underground. According to the current tunneling shield technology, the well tower can reach a maximum depth of 80 meters, and the maximum valid inner diameter can be over 15 meters (as shown in FIG. 5). Two rows of storage parking stalls 106 with five storage parking stalls 106 in each row can be arranged in the center of the well tower. One parking stall in the front of each row is used for conversion. Each layer has eight valid parking stalls. If a lifting horizontally-moving parking technology is used for every three layers, each of the other two layers has ten valid parking stalls. Three layers form one group and have a total of 28 valid parking stalls. The well tower is 80 meters deep. It is calculated according to each parking stall being 1.8 meters high that a vehicle rack having 44 layers can be arranged underground. Considering subsidence and flood control requirements of buildings, five more layers can be arranged aboveground for the well tower. Parking stall exits of the well tower should be preferentially arranged on the first layer to the third layer aboveground. The fourth layer and the fifth layer aboveground are to make full use of a buffering top height space of a high-speed vehicle-supporting elevator. In this way, 49 layers of the vehicle rack can be arranged in the vertical part. It is calculated according to every three layers having 28 valid parking stalls that theoretically 458 valid storage garage (parking) stalls 106 can be arranged. Four 3-meter/second vehicle-supporting elevators 103 can be arranged in the well tower. Two elevators 103 form one group and correspond to parking stalls in one same direction, so as to provide insurance for each other, thereby greatly enhancing the operational reliability of the parking garage. The design of the underground tower garage also provides a simple solution for fire protection in a large-scale mechanical parking garage.

The present invention can be applied to the internal structure of both a square (rectangular) building structure and a circular building structure. Here, a main body tower garage part of an underground parking garage is still used as an example. As shown in FIG. 5, the tunneling shield technology is used to build a circular space underground as a basis. The main body tower garage is provided in the center. All parking stalls are arranged in the center. Each layer has an upper row and a lower row. Each row has five parking stalls. One conversion parking stall is provided on one side of each row. Eight parking stalls can be arranged on an entire plane. These parking stalls are transported vertically by using an elevator A on the left side and an elevator B on the right side. An elevator C and an elevator D in a vertical direction are responsible for parking stalls in a dotted-line direction. Parking stalls of dotted line parts are obtained by rotating the original parking stalls in a horizontal direction by 90°. In this way, two elevators form one group, the four elevators operate without interfering with each other, and two of the four elevators are a complement to the other two. Therefore, the transportation capability is greatly increased, the efficiency is improved, and the safety and reliability are improved. In addition, according to requirements, parking stalls having two different types and sizes can be further designed in the horizontal direction and the vertical direction, thereby achieving the versatility of the garage. This function is highly significant for the future development of small-sized new-energy automobiles in the future in China, so that the vehicle storage capability can be further improved and different types of automobiles can be further stored according to market demands. There will be enormous influence on the development of the automobile industry in China.

A large-scale combined intelligent vertical mechanical parking garage is used as an example (FIG. 5 or FIG. 6) below to describe the application of the present invention in detail. Certainly, the present invention can also be applied to the fields of large-scale vertical mechanical warehouses and cargo warehousing.

Before leaving to retrieve a vehicle, a vehicle owner first uses a mobile phone client to send an instruction of retrieving the vehicle in a few minutes (the time can be estimated), and also can specify a ground lateral garage 105 to retrieve the vehicle (for example, the vehicle owner wants to retrieve the vehicle at a garage A).

A computer control center of the parking garage receives the instruction and calculates the suitable time of sending an instruction to the parking stall of the vehicle. A storage garage (parking) stall 106 on the central vehicle rack in the tower garage is started and automatically runs to a turnover parking stall 104 in the direction of the ground lateral garage A 105. If at this time a vehicle-supporting elevator A encounters a failure or the garage A has received too many orders, the control center sends a change instruction "We are sorry to inform you that the garage A has encountered an elevator failure (or the garage A is currently crowded). The waiting time would be too long if you still want to retrieve your vehicle at the exit of the garage A. We will change the exit position of your vehicle to the garage B. Thank you for your comprehension." to the vehicle owner.

Figure 1:
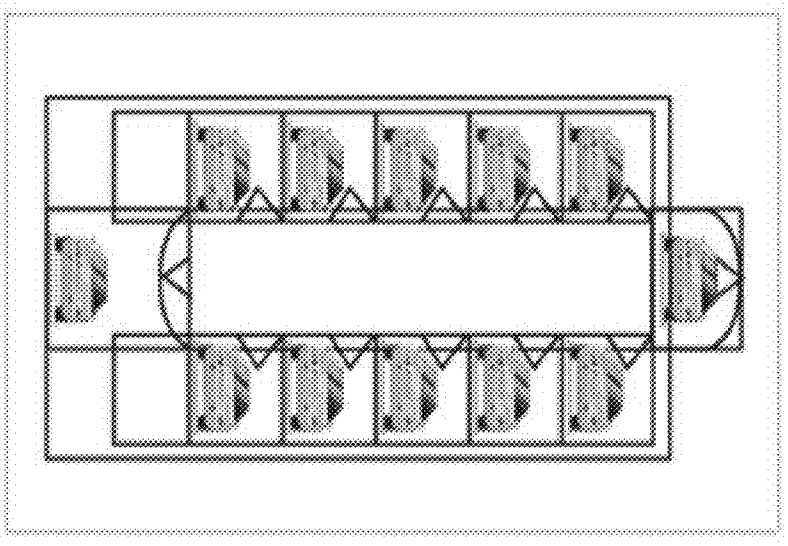
FIG. 1 shows a schematic diagram of the internal arrangement of a square (or rectangular) tower garage in the background art.
Figure 2:
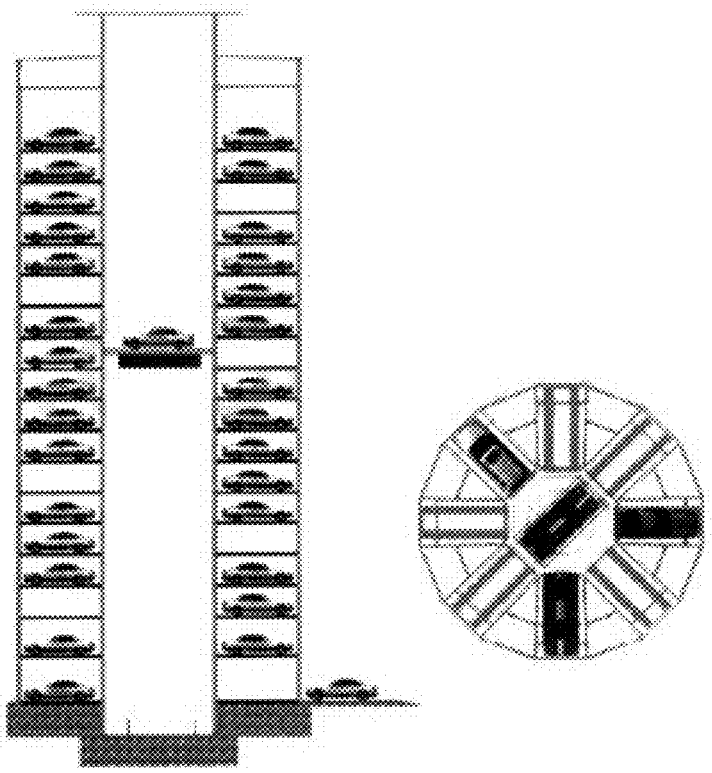
FIG. 2 shows a schematic diagram of the internal arrangement of a circular tower garage in the background art.
Figure 3:
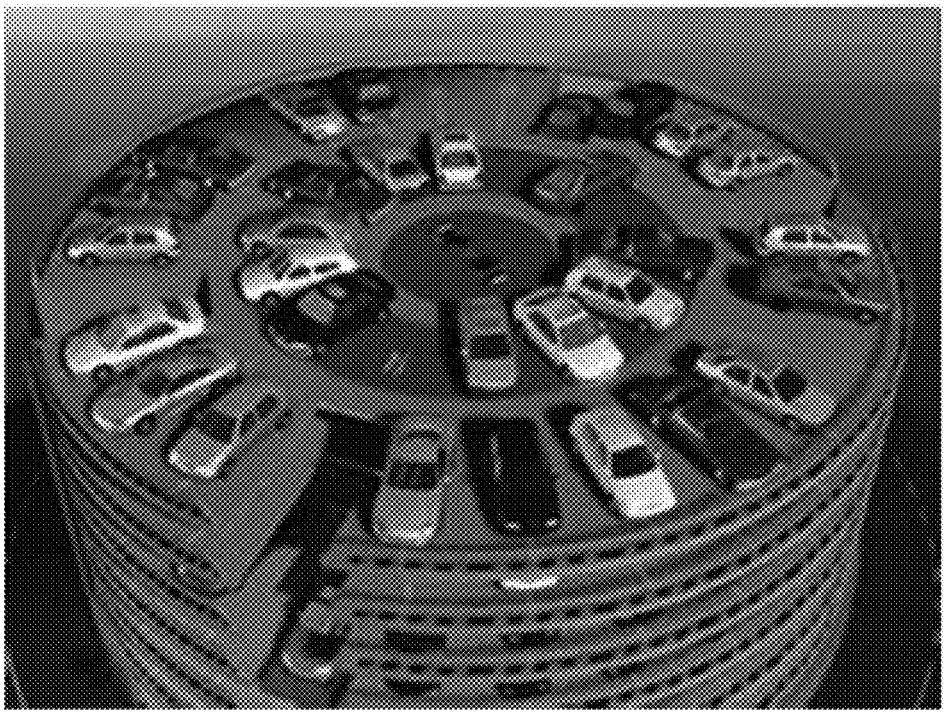
FIG. 3 shows a schematic diagram of the internal arrangement of another circular tower garage in the background art.
Figure 4:
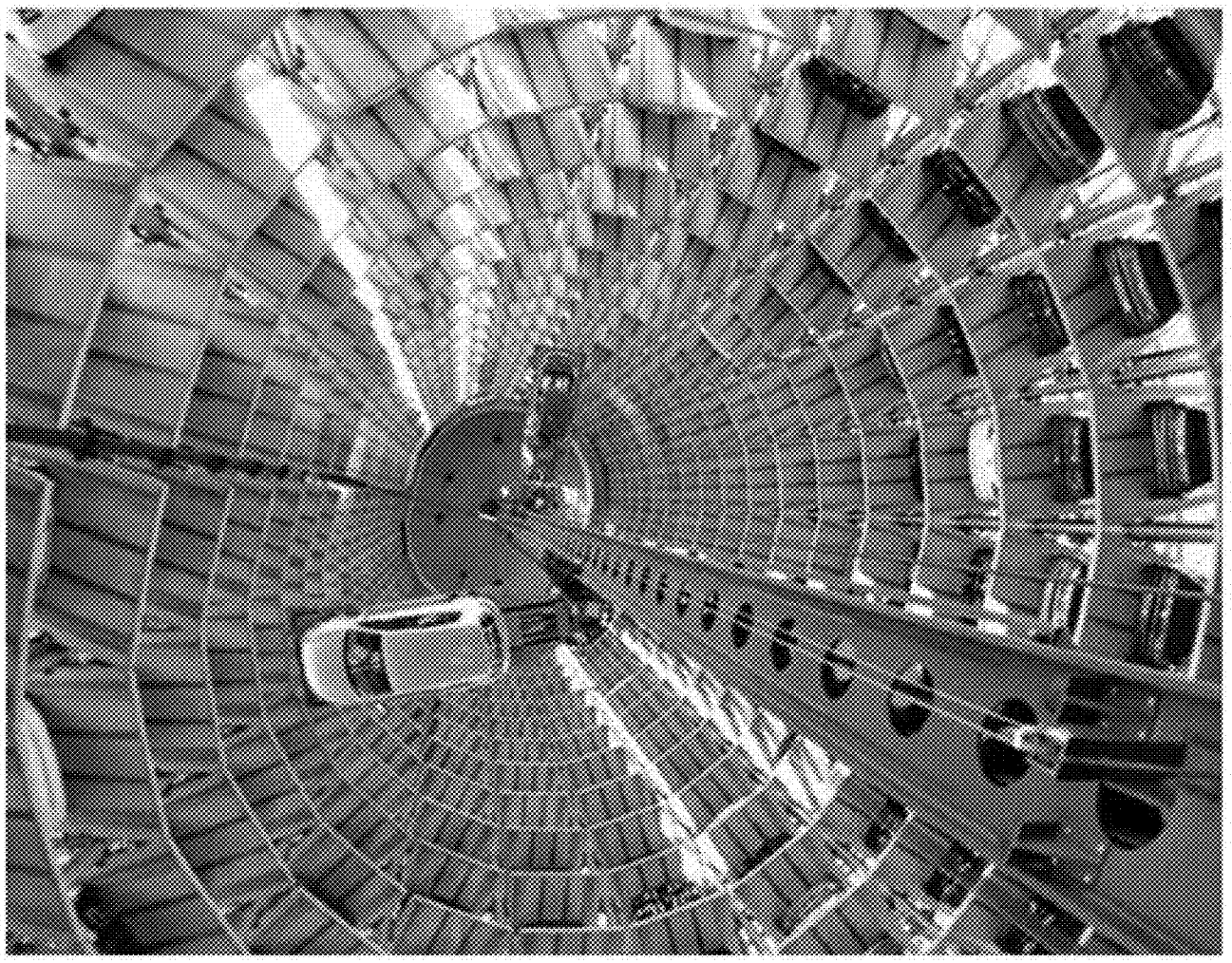
FIG. 4 shows a schematic diagram of the internal arrangement of another circular tower garage in the background art.

After receiving the confirmation from the vehicle owner, the parking stall on the central vehicle rack in the tower garage is started again and runs to a turnover parking stall 104 in the direction of the ground lateral garage B 105. The turnover parking stall is switched to a vehicle exit mode and runs to the position in FIG. 3 to wait for conversion by the vehicle-supporting elevator 103 of the garage B.

Figure 7:
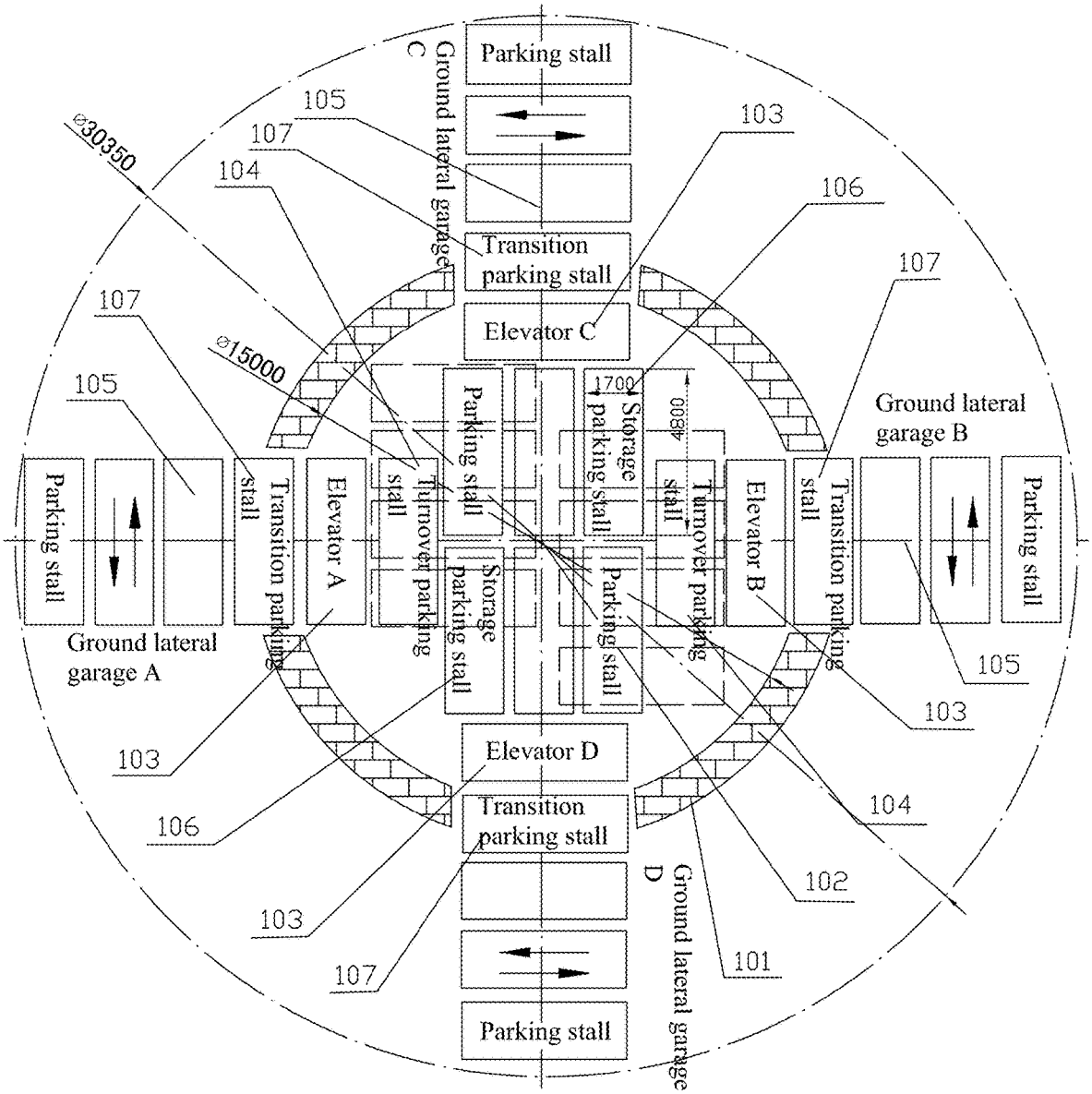
FIG. 7 shows a schematic diagram of working positions of turnover parking stalls in a system for arranging a vertical lifting intensive parking garage.
Figure 8:
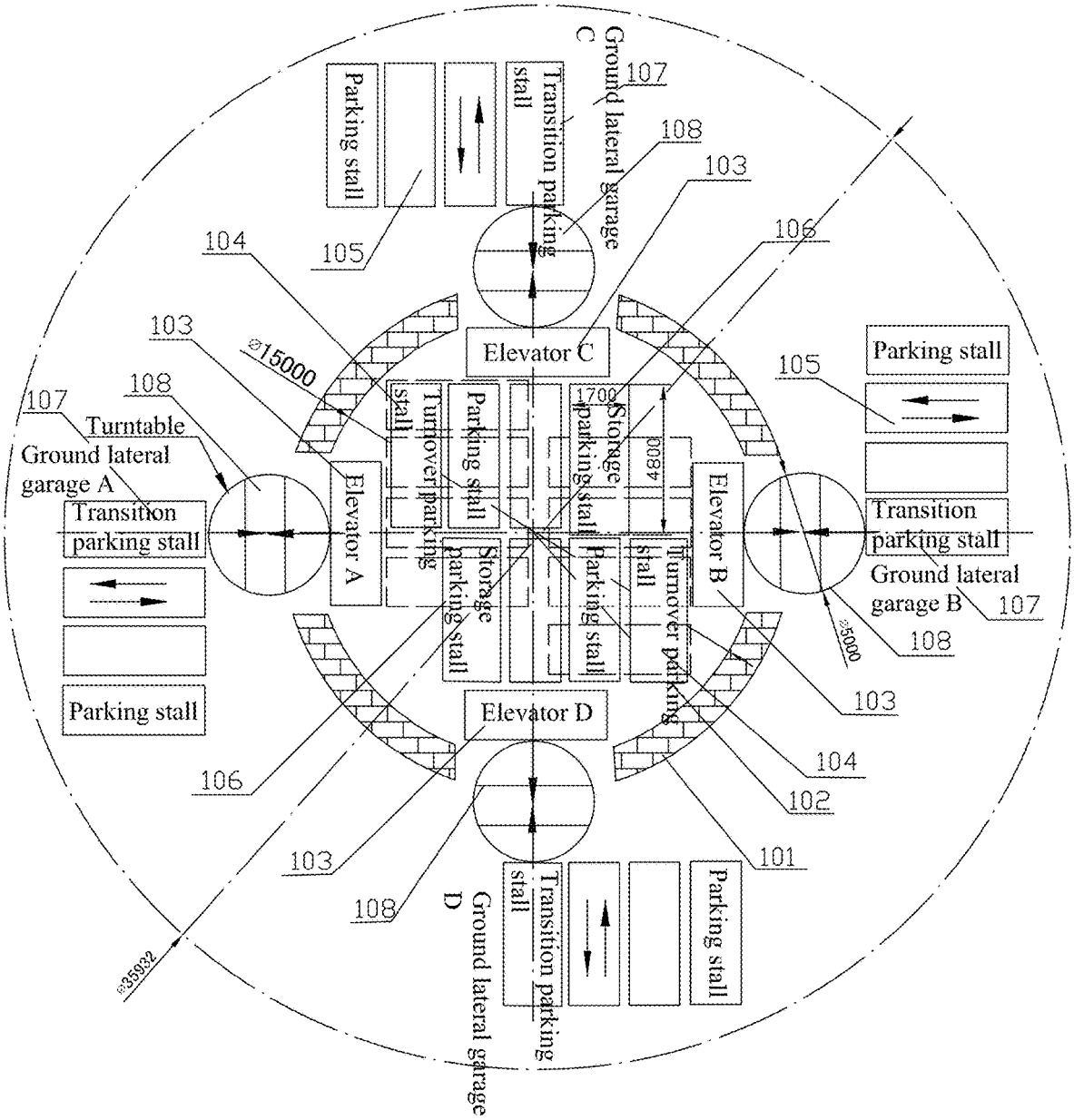
FIG. 8 shows a schematic diagram of a variant of a system for arranging a vertical lifting intensive parking garage.
Figure 9:
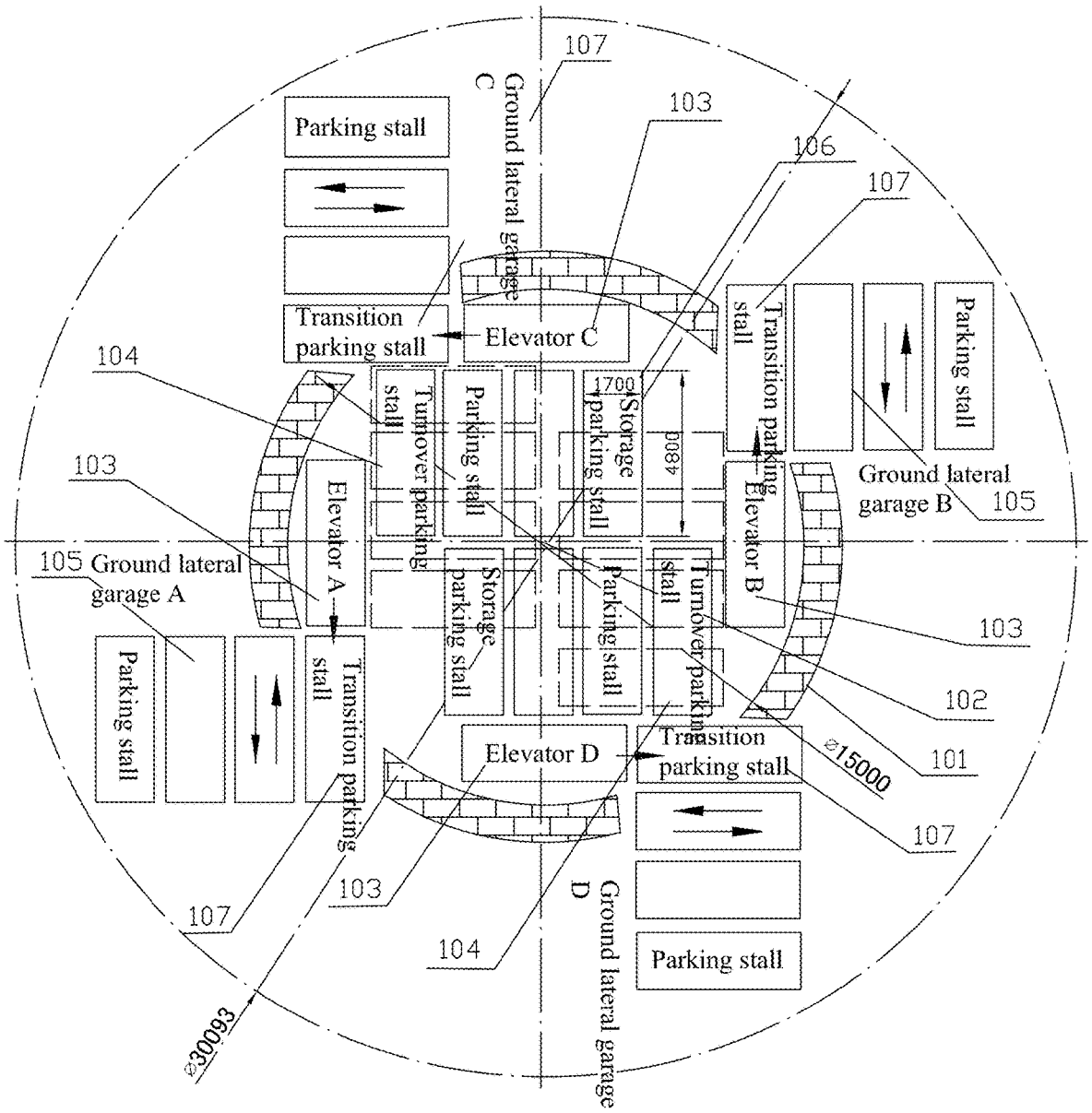
FIG. 9 shows a schematic diagram of a variant of a system for arranging a vertical lifting intensive parking garage.
Figure 10:
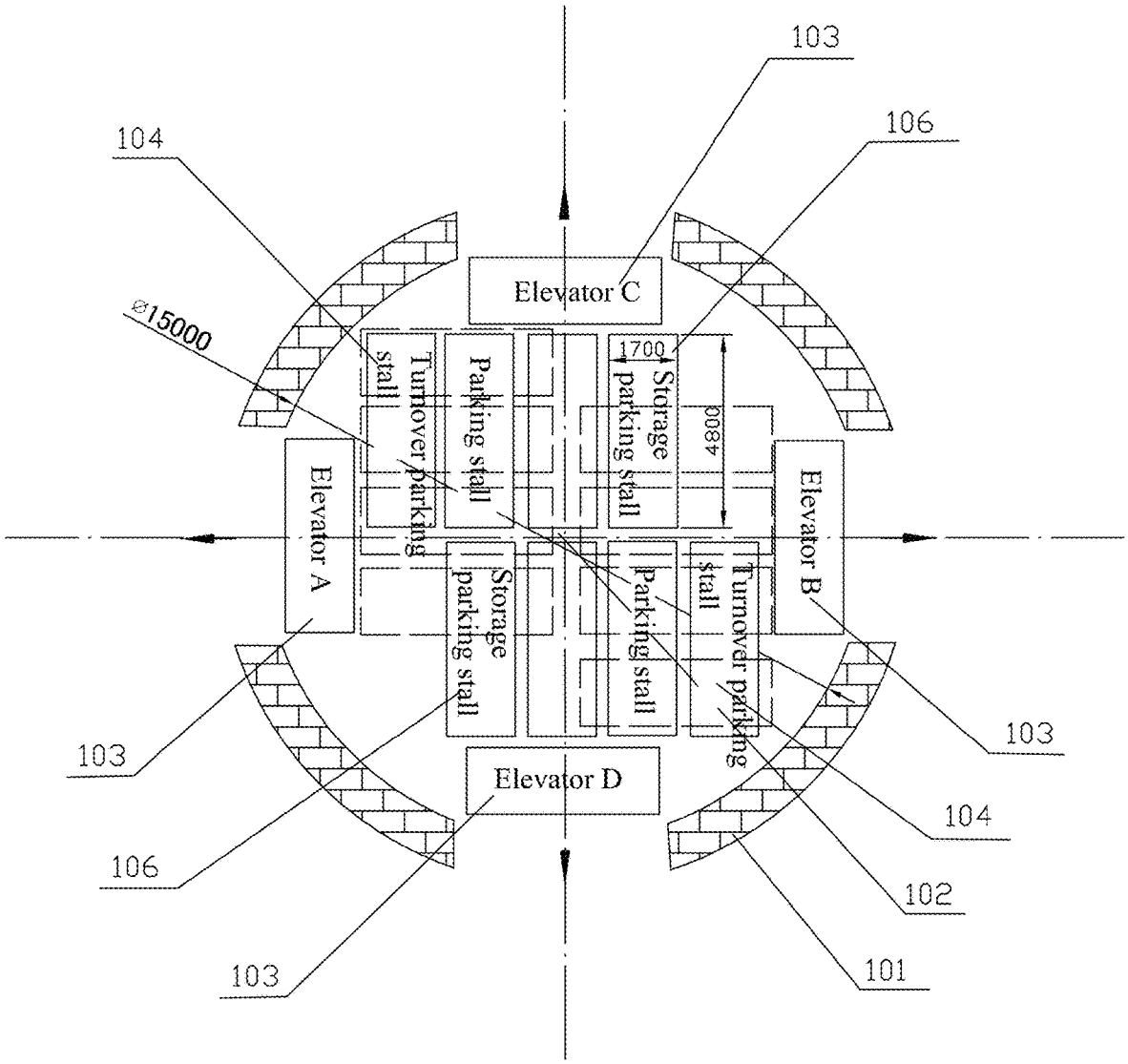
FIG. 10 shows a schematic diagram of a system for arranging a vertical lifting intensive parking garage (circular tower garage).

When the elevator of the garage B runs to the turnover parking stall (as shown in FIG. 7), the vehicle is horizontally moved to the elevator B through a mechanical movement. When the elevator B runs to the exit of the garage B and is aligned with a transition parking stall 107 of the garage B, the vehicle is horizontally moved to the transition parking stall 107 of the garage B again. At this time, the control center sends a notification "Your vehicle has arrived at the garage B. Please confirm the vehicle retrieval time again." to the vehicle owner.

At this time, the vehicle owner uses the mobile phone client to confirm the precise arrival time again. For example, the precise arrival time is three minutes later. The control center performs calculation and instructs the parking stall to run to an exit (for example, a No. 1 exit) of a parking stall. At the same time, the control center sends a confirmation instruction "Your vehicle will be waiting at No. 1 Exit of Garage B in three minutes. Have a nice trip!" to the mobile phone client.

After receiving the information, the vehicle owner can go to the No. 1 exit of the garage B with no hurry and open the mobile phone client to perform a scan for confirmation to retrieve the vehicle.

The parking process is similar. A vehicle owner drives a vehicle near the parking garage, moves the vehicle to the entrance of a parking stall of a garage according to a vacancy prompt, checks the inside of the vehicle, gets out of the vehicle, opens the mobile phone client, scans information of the parking stall, starts a parking procedure, and leaves. The vehicle automatically runs to a specified vacancy in the tower garage according to an internal procedure of parking garage, to implement an automatic parking requirement.

It can be seen from the example that the vehicle owner does not spend much time and energy looking for a parking stall or waiting to retrieve a vehicle during vehicle access, and "parking and retrieval on arrival" can be completely achieved. In addition, vehicles are completely prevented from discharging pollutants ($PM_{2.5}$ are the major pollutants) at idle or low speed when looking for parking stalls. Therefore, an "environmentally-friendly parking garage" is implemented.

Specifically:

Referring to FIG. 5 to FIG. 9 and FIG. 10, the present invention adopts a system for arranging a vertical lifting intensive parking garage.

The main body tower garage part 101 is provided with separation layers. A storage rack 102 composed of a plurality of storage garage spaces 106 is arranged in the center of the main body tower garage part 101. The storage rack 102 is provided with turnover parking stalls 104. The turnover parking stalls 104 are joined to the vehicle-supporting elevators 103. Storage garage spaces 106 of two adjacent separation layers are perpendicular to each other.

The operation of the system for arranging a vertical lifting intensive parking garage is controlled by a central server. The central server is connected to a mobile phone terminal of a user via the Internet. The user can place an access order by using the mobile phone terminal.

The turnover parking stalls 104 are disposed on two sides of each group of planar storage racks 102. During operation, each turnover parking stall 104 can be aligned with the vehicle-supporting elevator 103, and a vehicle-supporting apparatus at the bottom of a vehicle can be used to move the vehicle horizontally. There are four ground lateral garages 105. One of the transition parking stalls 107 is aligned with the vehicle-supporting elevator 103 at an exit of the tower garage 101. A vehicle can also be moved horizontally. The four lateral garages 105 are four standard multi-layered lifting horizontally-moving parking garages. A ground layer has entrance and exit parking stalls for vehicles. A vehicle can be directly driven into or out from a ground parking stall in each lateral garage 105. Alternatively, a ground mechanical apparatus can make a forward or backward movement according to an instruction to actively move a vehicle into (or out from) a parking stall in the lateral garage. The entire parking garage is intelligently connected to user terminals via the Internet by using servers. An owner only needs to park a vehicle outside an indicated ground exit. By using an instruction from a user terminal, the vehicle automatically enters the ground lateral garage 105. The vehicle automatically runs by using an instruction from the server of the parking garage to enter the transition parking stall 107. The vehicle is moved horizontally to the vehicle-supporting elevator 103. The vehicle then runs to a specified position by using an elevator, is moved horizontally to a turnover parking stall 104, and then runs to a vacant storage garage (parking) stall 106. When a vehicle is to leave the garage, same operations are performed. The vehicle runs to one of the four lateral garages in advance for storage, and arrives at a specified parking stall at a specified time. An underground mechanical apparatus pushes the vehicle outside a specified parking garage. The owner arrives on time to directly drive the vehicle away. Preferably, the vehicle-supporting elevators 103 are arranged on four sides in the main body tower garage 101.

The ground lateral garage 105 is a multi-layered lifting horizontally-moving parking garage. A ground layer parking stall in the ground lateral garage 105 is used as an entrance and exit of a vehicle. The ground lateral garage 105 is provided with a transition parking stall 107. The transition parking stall 107 is joined to the vehicle-supporting elevator 103.

The storage rack 102 composed of the plurality of storage garage spaces 106 is a separate planarly-moving vehicle rack. The quantity of the vehicle-supporting elevators 103 is 2, 4 or 8, and is preferably 4.

Preferably, the storage rack 102 composed of the plurality of storage garage spaces 106 is a multi-layered lifting horizontally-moving vehicle rack.

Preferably, a turntable 108 is provided between a tower garage exit of the vehicle-supporting elevator 103 and the ground lateral garage 105.

Preferably, parking stalls in the ground lateral garage 105 are arranged in rows in a width direction of the parking stall in the vehicle-supporting elevator 103. A parking stall on a side, near the vehicle-supporting elevator 103, of the ground lateral garage 105 is located on a side of the vehicle-supporting elevator 103 in a length direction.

Preferably, the vehicle-supporting elevator 103 is provided with a parking stall. The parking stalls in the ground lateral garage 105 are arranged in rows in the width direction of the parking stall in the vehicle-supporting elevator 103. A parking stall on a side, near the vehicle-supporting elevator 103, of the ground lateral garage 105 is located on a side of the vehicle-supporting elevator 103 in the width direction.

The present invention uses a proper parking stall layout and uses a vertical transportation manner with multiple insurance (the operation of the entire parking garage is not affected because one device fails) to enhance the safety and reliability of the entire parking garage. The present invention combines the characteristic of versatile entrances and exits of a lifting horizontally-moving garage and the intelligent Internet technology to resolve the disadvantage that a vertical lifting garage has only a few entrances and exits, thereby shortening the waiting time for accessing vehicles and achieving zero wait for vehicle access, so as to improve the use efficiency of the overall parking garage.

The foregoing disclosure is an example of a main body tower garage built by using the tunneling shield technology. Due to the limitations on inner diameters of tower garages, only one row or two rows of storage garage spaces 106 can be arranged on a single layer of the storage rack 102.

In the present invention, a vehicle can be retrieved in advance by using the foregoing structure in the large-scale main body tower garage part 101, so that a vehicle owner is spared from the trouble of waiting in a line to retrieve a vehicle.

The objective of the present invention is to provide an intelligent and efficient vertical mechanical parking garage that has a large vehicle storage capability, high safety and reliability, high flexibility, a large number of entrances and exits, and a shorter waiting time during vehicle access.

The present invention organically combines a vertical lifting manner and a lifting horizontally-movement manner, uses a proper parking stall layout, increases the number of vertical elevators (vehicle-supporting elevators), and uses a vertical transportation manner with multiple insurance (the operation of the entire parking garage is not affected because one device fails) to enhance the safety and reliability of the entire parking garage. The present invention combines the characteristic of versatile entrances and exits of a lifting horizontally-moving garage and the intelligent Internet technology to resolve the disadvantage that a vertical lifting garage has only a few entrances and exits, thereby shortening the waiting time for accessing vehicles and achieving zero wait for vehicle access, so as to improve the use efficiency of the overall parking garage. Theoretically, the present invention can provide a large-scale parking garage that has more than 450 parking stalls and occupies a very small area (approximately 700 square meters), so as to completely resolve the parking problem for a range of at least 1 square kilometer. The advantage is that the building costs are high. However, in comparison, a common above-ground parking stall occupies about 15 square meters, each parking stall of a common underground parking lot occupies 25 square meters, and each parking stall in an existing vertical garage occupies an average of 4 square meters. With current high land prices, for a parking garage that has 450 parking stalls in which each parking stall occupies an area of only one square meter, the corresponding parking garage has very low costs, and the social benefits and economic benefits are amazingly high. The present invention is a completely new innovation for cities.

Preferably, a cab of the vehicle-supporting elevator 103 is provided with at least two cab parking stalls. The central server of the vehicle-supporting elevator 103 comprises a cab tonnage measurement unit, a cab parking stall determining unit, a CPU, and a communications unit.

The cab tonnage measurement unit is configured to: measure a total weight of the cab and a vehicle in the cab, and output first cab information according to the total weight in the cab.

The cab parking stall determining unit is configured to: determine a parking stall occupancy quantity in the cab, and output second cab information according to the parking stall occupancy quantity.

The CPU is configured to recognize whether the first cab information is less than the total weight. The CPU is configured to recognize whether the second cab information is equal to a total parking stall quantity of the cab.

When the first cab information is greater than or equal to the total weight, or, the second cab information is equal to the total parking stall quantity of the cab, the CPU outputs, by using the communications module to a driving module, an instruction of directly reaching a farthest separation layer.

The CPU is further configured to recognize whether the first cab information is greater than a half of the total weight. The CPU is further configured to recognize whether the second cab information is greater than a half of the total parking stall quantity of the cab.

When the second cab information is greater than the half of the total weight, or, when the second cab information is greater than the half of the total parking stall quantity of the cab, the CPU controls another cab to stop at a specified separation layer.

For the vehicle-supporting elevator in the present invention, when the parking stalls in a cab are full or the parking weight of a cab is reached, the cab can directly reach a parking stall instead of an intermediate floor, thereby avoiding the problem that the elevator door of the intermediate floor is open but no more vehicle can enter the vehicle-supporting elevator. In addition, comparison can be performed with a half of a rated bearing capability, so that transportation tasks can be better allocated to the plurality of cabs, the service life of the cabs is ensured, and the use reliability of the cabs is improved.

The foregoing embodiments are only the descriptions of the preferred implementations of the present invention rather than to limit the scope of the present invention. Various variations and improvements made by a person of ordinary skill in the art to the technical solutions of the present invention without departing from the design and spirit in the present invention all shall fall within the protection scope determined by the claims of the present invention.

What is claimed is:

1. A method for arranging a vertical lifting intensive parking garage, comprising:

a main body tower garage comprising a plurality of layers, wherein each of the plurality of layers comprises:

a storage rack;

storage garage spaces arranged on the storage rack and located on a central area of the main body tower garage;

a first and a second pair of vehicle-supporting elevators arranged in position around a periphery of the central area of the main body tower garage, wherein the first pair of vehicle-supporting elevators are perpendicularly oriented relative to the second pair of vehicle-supporting elevators, and wherein the storage rack is configured to rotate the storage garage spaces to be aligned with the first pair or the second pair of vehicle-supporting elevators;

a left and a right turnover parking stall each joined to a corresponding one of the pairs of vehicle-supporting elevators; and a central server in electrical communication with a mobile phone terminal of a user via the Internet, wherein the user places an access order by using the mobile phone terminal;

wherein the main body tower garage is in a fully-automatic intelligent operation and the user retrieves a vehicle without entering the main body tower garage, and wherein the storage garage spaces having different sizes are arranged on the storage rack of the different one of the plurality of layers, respectively.

2. The method for arranging a vertical lifting intensive parking garage according to claim 1, wherein the storage rack on each one of the plurality of layers is configured to be independently movable from other storage racks on different layers.

3. The method for arranging a vertical lifting intensive parking garage according to claim 1, wherein according to an instruction sent by the central server, the storage rack on each layer of the main body tower garage is configured to move each of the storage garage spaces onto the left or right turnover parking stalls to be joined to the first pair of vehicle-supporting elevators.

4. The method for arranging a vertical lifting intensive parking garage according to claim 1, wherein the storage garage spaces having different sizes are arranged on different layers of the main body tower garage, wherein, the storage garage spaces comprise a first group of the storage garage spaces having a first size and a second group of the storage garage spaces having a second size, wherein the first group of the storage garage spaces are paired and rotated by a set angle so as to be joined to the first pair of vehicle-supporting elevators sized to accommodate the first group of the storage garage spaces having the first size, and the second group of the storage garage spaces are paired and rotated by another certain angle so as to be joined to the second pair of vehicle-supporting elevators sized to accommodate the second group of storage garage spaces having the second size;

wherein the first group of the storage garage spaces are vertically arranged above the second group of the storage garage spaces on the storage rack.

5. The method for arranging a vertical lifting intensive parking garage according to claim 1, wherein the main body tower garage is built according to a vertical underground tunneling shield technology, and one row or two rows of storage garage spaces is arranged on a single one of each layer of the main body tower garage.

6. The method for arranging a vertical lifting intensive parking garage according to claim 1, wherein the storage garage spaces of two adjacent layers of the plurality of layers are perpendicular to each other.

* * * * *